United States Patent [19]

Bohg et al.

[11] Patent Number: 4,664,543

[45] Date of Patent: May 12, 1987

[54] DEVICE FOR MONITORING AND COMPENSATING FOR CHANGES IN THE FLIGHT TIME OF THE PRINT HAMMERS OF IMPACT PRINTERS

[75] Inventors: Armin Bohg, Weil-Neuweiler; Horst D. Matthaei, Waldenbuch; Volker Zimmermann, Sindelfingen, all of Fed. Rep. of Germany

[73] Assignee: International Business Machines Corporation, Armonk, N.Y.

[21] Appl. No.: 842,064

[22] Filed: Mar. 18, 1986

Related U.S. Application Data

[63] Continuation of Ser. No. 620,285, Jun. 13, 1984, abandoned.

[30] Foreign Application Priority Data

Aug. 2, 1983 [EP] European Pat. Off. ..... 83107603.9

[51] Int. Cl.[4] ..... B41J 1/46

[52] U.S. Cl. ..... 400/174; 400/53; 400/146; 400/466; 400/166; 101/93.03; 101/93.13; 101/399

[58] Field of Search ..... 101/93.03, 93.13, 93.14, 101/398, 399, DIG. 27; 400/144.2, 144.3, 166, 704, 53, 74, 146, 174, 462, 466, 679, 703, 719

[56] References Cited

U.S. PATENT DOCUMENTS

| | | | |
|---|---|---|---|
| 3,513,774 | 5/1970 | Pawletko | 317/148.5 |
| 3,835,771 | 9/1974 | Funk et al. | 101/93.14 X |
| 3,872,788 | 3/1975 | Palumbo | 101/93.14 |
| 4,173,927 | 11/1979 | Van Kempen et al. | 101/93.03 |
| 4,347,786 | 9/1982 | Sweat, Jr. et al. | 400/144.2 |
| 4,425,844 | 1/1984 | Carrington | 101/93.14 |

FOREIGN PATENT DOCUMENTS

| | | | |
|---|---|---|---|
| 0137985 | 10/1981 | Japan | 400/697 |
| 0083481 | 5/1982 | Japan | 400/166 |
| 1456801 | 11/1976 | United Kingdom . | |

OTHER PUBLICATIONS

IBM Technical Disclosure Bulletin, "Print Hammer Flight Time Control", by Hsieh et al., vol. 24, No. 9, p. 4707, 2-82.

*Primary Examiner*—Edgar S. Burr
*Assistant Examiner*—David A. Wiecking
*Attorney, Agent, or Firm*—J. Jancin, Jr.; J. Gasper

[57] ABSTRACT

A device for monitoring and compensating for changes in the flight time of the print hammers of impact printers is disclosed. The flight time of the respectively monitored hammer is calculated from the elapsed time between the moment of firing of a hammer and the moment of impact of the print type carrier against the impact platen. In order to ensure automatic self-adjustment of all print hammers in predetermined test cycles, without the actual printing process itself being affected, and without there being any test imprints on the record carrier, the print type carrier includes, in addition to the standard print types, an additional test type. The impact surface area of the test type is large enough such that no visible imprint is made upon its impact on the record carrier because of the low impact pressure.

28 Claims, 4 Drawing Figures

DEVICE FOR MONITORING AND COMPENSATING FOR CHANGES IN THE FLIGHT TIME OF THE PRINT HAMMERS OF IMPACT PRINTERS

This is a continuation of application Ser. No. 620,285, filed June 13, 1984, now abandoned.

BACKGROUND OF THE INVENTION

1. Field of the Invention

The invention relates to a device for monitoring and compensating for change in the flight time of the print hammers of impact printers.

2. Description of the Prior Art

In impact printing, the printing process is carried out by the movement and impact of a print hammer against a passing print type carrier, which subsequently strikes an impact platen. Printing type carriers commonly used are steel belts with etched types, belts with dot elements and daisy wheels.

The time between the moment of firing of the print hammer and the moment at which the print type carrier strikes the impact platen is commonly referred to as the flight time. In high speed line printers, the timing sequence for firing the print hammers must be very precise in order to ensure that the desired print type is aligned in its proper position when the hammer impacts against it. This precision requires that the flight times of the print hammers be known and the moments of impact be relatively constant. However, the flight times of print hammers in high speed line printers are gradually and continually changing as the machine is in use. Possible reasons are wear of the print hammer surfaces, change of the flight distance to be covered, change in the mechanical friction of the hammer firing mechanism, variations of the electrical voltage within the printer electronics, temperature variations, etc. Changes of the flight time have a direct and significant influence on the quality of the printing.

In printers having individual print hammers at each printing position, the frequency of use of each individual print hammer affects its flight time independent of the other print hammers. Therefore, it is necessary to periodically adjust the flight times of all the print hammers so that flight time remains a constant. Typically this is done by manual adjustment of the hammer flight distances. This manual adjustment is very costly, very time consuming, and does not prevent a deterioration of the print quality in the interval between two manual adjustments.

It is desirable to replace the manual adjustment procedure with an automatic adjustment procedure in which differences in flight times would be compensated for by shifting the moments of firing of each individual print hammer. By shifting these firing times, the impact times of each print hammer will be precisely maintained in the timing pattern of the printing sequence. In order to be able to automatically adjust the firing time of each print hammer, the precise moment of impact of the print type carrier on the impact platen must be determined. Prior art devices for monitoring the flight times of print hammers of impact printers primarily utilize two approaches.

In the first approach, a test line is periodically printed, the flight times are measured, and flight time differences of the individual print hammers are electronically compensated for. A considerable disadvantage of this method is that the separate test line is actually printed, which is not particularly desirable. Disengagement of the ribbon is not a practical solution, as it is inconvenient and typically not effective since carbon paper is frequently used.

The other principal approach involves the measurement of the flight time of each individual print hammer during standard printer operation. A disadvantage of this method is that the flight times of print hammers in print positions that are not used in a particular print line cannot be adjusted. Furthermore, the flight times of the individual print hammers overlap so that their impact times cannot easily be associated with their particular print position, unless a separate transducer or sensor for the moment of impact is provided for each individual print hammer. This method can be quite expensive and complex, and frequently causes interruptions of the other printer functions.

An automatic device for monitoring and compensating for change in the flight times of each and every individual print hammer that overcomes these shortcomings is desirable.

SUMMARY OF THE INVENTION

It is the object of this invention to provide an improved device for monitoring and compensating for changes in the flight times of individual print hammers of impact printers which permits automatic self-adjustment of the printer without necessitating test printouts, without affecting other printer functions, and without involving costly, complex methods.

It is a further object of the invention to provide a device for monitoring and compensating for changes in the flight times of print hammers of impact printers which does not require any mechanical adjustment of the print hammers so that the maintenance period of printers could be drastically reduced.

It is still another object of the invention to provide a device for monitoring and compensating for changes in the flight times of print hammers that does not leave any visible traces on record carriers during a test cycle.

It is also an object of this invention to provide a device for monitoring and compensating for changes in the flight times of print hammers that can be used in various impact printers such as chain printers, daisy wheel printers, etc.

In accordance with these objects, a print type carrier includes an additional test type with a large impact surface area. The print pressure resulting from impact of the test type on a record carrier is low enough that there is no imprint visible. The flight time of each individual print hammer is monitored using said test type while the impact of the test type on the impact platen is detected with an impact detector. The flight time for each print hammer is stored in a microprocessor and the firing sequence is adjusted to compensate for changes in the flight times.

BRIEF DESCRIPTION OF THE DRAWING

The foregoing and other advantages of the invention will be more fully understood with reference to the description of the preferred embodiment and the drawing wherein.

DESCRIPTION OF THE PREFERRED EMBODIMENT

Figure 1:
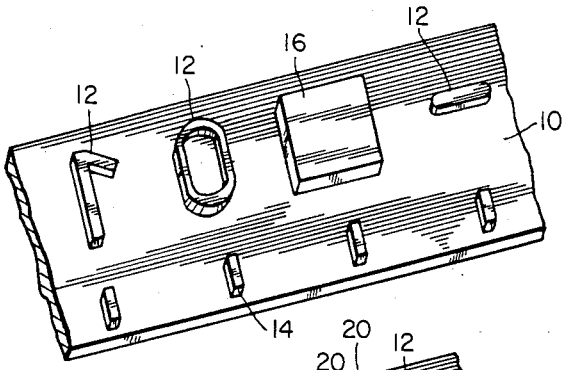
FIG. 1 is a schematic representation of a segment of a steel belt used as a print type carrier having conventional print types and a test type as disclosed by the invention.

Although the invention may be used with any type of impact printer, the detailed description will be made in relation to a high speed printer having a steel belt as the print type carrier. Referring to FIG. 1, in the preferred embodiment, the print type carrier 10 is a steel band having projecting print types 12 made, for example, by etching or engraving the steel band. In addition to these print types 12, the print type carrier 10 also includes positioning marks 14 which indicate the location of the individual print types 12 of the print type carrier 10 during its circulation through the printer.

In addition to the conventional set of print types, the print type carrier 10 of the invention also comprises at least one test type 16. This test type 16 projects from the print type carrier 10 like the print types 12, but has an impact surface area much greater than those of print types 12. Because the impact surface area of the test type 16 is so large, it will not cause a visible imprint on a record carrier when impacted. An imprint will appear only in those cases where the projecting surface of a print type 12 is smaller than a predetermined value, e.g., 1 $mm^2$. If the surface area of the test type 16 is the same as a conventional impact print hammer, e.g., 12.5 $mm^2$, the impact pressure per surface area would be more than 12 times lower than that required for printing, so that the impact would not initiate a printing process.

In the embodiment of FIG. 1, test type 16 is fabricated through an etching process of the steel band as are the other print types 12. This method of fabricating test type 16 can cause problems because of its large surface area. Rigid connection of such a large test type may impair the flexibility of the print type carrier 10. In a band printer such as this, the print type carrier 10 is designed as a closed loop and must circulate continuously passed the printing station, requiring that flexibility be maintained.

Figure 2A:
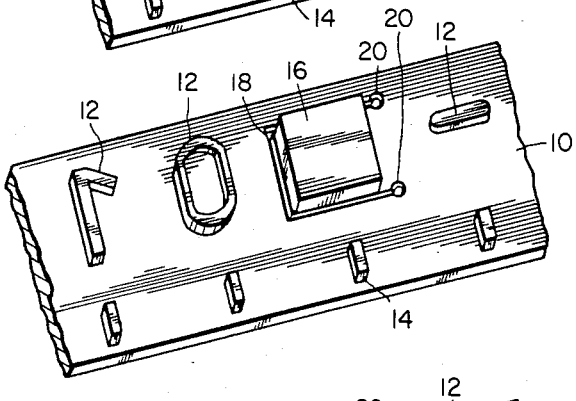
FIGS. 2A and 2B illustrate two types of connections of the test type to the print type carrier.
Figure 2B:
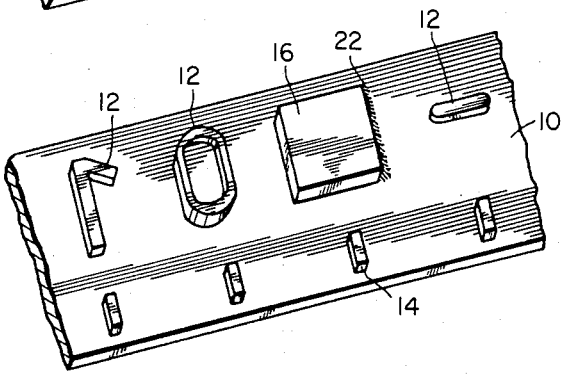

FIGS. 2A and 2B schematically illustrate two other methods of fixedly connecting the test type 16 to the steel belt. In the embodiment of FIG. 2A, the test type 16 is fixedly attached to a U-shaped element 18 which itself is connected to the steel belt by its two end points 20. Since the connection of the end points 20 is resilient, the flexibility of the steel belt is insured.

In the embodiment of FIG. 2B, test type 16 is connected to the print type carrier 10 via a welding seam 22 on one side, so that flexibility is also maintained.

Figure 3:
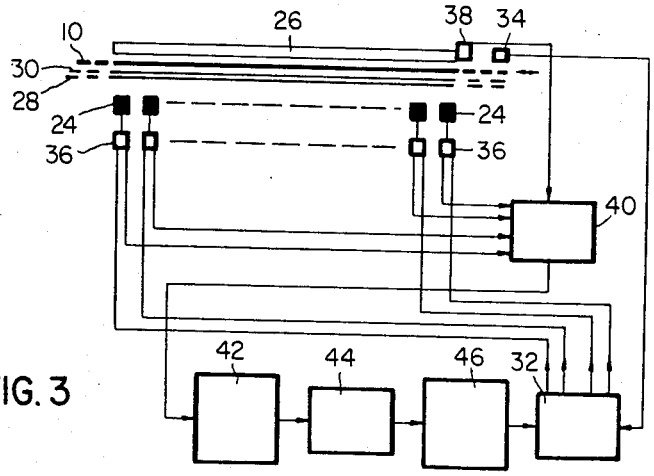
FIG. 3 is a block diagram of a printer and its electronics for monitoring the flight times and automatic adjustment of the firing moments of the print hammers of a line printer.

FIG. 3 schematically represents the printing station of a line printer. A print hammer bank is provided with one print hammer 24 for each possible printing position (132 print hammers in this embodiment). The print hammer bank is provided opposite an impact platen 26. When a printing type for a desired character reaches the specific printing position at which it is to print, the print hammer 24 associated with that print position is fired. The print hammer 24 then impacts against record carrier 28, ribbon 30, print type carrier 10 and finally against impact platen 26, thereby imprinting on the record carrier 28. The individual print hammers 24 each have firing circuits 36 associated with them which are controlled via printing electronics 32, which are conventional and not described in detail herein. Printing electronics 32 themselves are controlled by a sensor 34 which senses the positioning mark 14 of FIGS. 1, 2A and 2B on print type carrier 10.

Referring back to FIG. 3, the flight time is defined as the period between the moment of firing of the print hammer by firing circuit 36, and the moment of impact of the print type carrier 10 on impact platen 26. During a test cycle, the moment of impact is determined by an impact detector 38 fixedly attached to impact platen 26. This impact detector 38 supplies a signal each time a print hammer 24 impacts the print type carrier 10 against impact platen 26. The correlation of the impact signal to a printing or hammer position is easily accomplished since during the test cycle, only one print hammer is fired at a time.

The impact detector 38 is designed in such a manner to respond to the shock wave generated in the impact platen 26 when a print hammer impacts on test type 16. The mechanical shock waves can be registered by any one of three basic types of impact detectors: electrical, optical, or mechanical, all of which are well known in the art. In the preferred embodiment an electrical impact detector is utilized, which can include strain gauges, piezoelectric sensors, and capacitive detectors.

The impact signal generated by impact detector 38 is applied to an electronic evaluator circuit 40 which also receives the firing signals supplied by firing circuit 36. Electronic evaluator unit 40 calculates the print hammer flight time from the time difference between the impact signal and the associated firing signal, and transmits these data to a series arranged print hammer flight time storage 42. The output of print hammer flight time storage 42 is connected via a microprocessor 44 to the inputs of a release time storage 46. The output of this storage is connected to the previously mentioned printer electronics 32 whose output signals control the firing circuits 36.

When initially setting up the printer, the operator will first manually adjust the firing times of all the print hammers such that all printing types are centrally impacted. The mean value of the flight times of all print hammers arranged in the printing station is then calculated and stored. Individual print hammers whose flight time differs from that mean value by a predetermined amount are adjusted by shifting their firing moments.

Automatic correction of the flight times will then take place as follows. At specific intervals a test cycle is initiated utilizing the large surface area test type 16. The flight time measured for each individual print hammer 24 is measured via electronic evaluator circuit 40, and stored in print hammer flight time storage 42. Microprocessor 44 then generates the mean value, detects deviations exceeding a predetermined level, and calculates new firing times for the individual print hammers. The end result of the test cycle ensures that the moments of impact will remain relatively constant. The firing moments of all print hammers are stored in firing time storage 46 from where they are made available to print electronics 32 controlling firing circuits 36.

The device according to the invention makes it possible to operate without any mechanical adjustment of the print hammers. The automatic measurement of and compensation for deviations in the hammer flight times does not leave any visible imprints and can be effected at any time. Even the print hammers that are used sporadically during printing are continuously tested and are always adjusted with the proper firing moment.

While the invention has been particularly shown and described with reference to a preferred embodiment thereof, it will be understood by those skilled in the art that various changes in detail may be made therein without departing from the spirit, scope and teaching of the invention. This would, of course, include the incorporation of the invention into any other type of impact printer, including dot and daisy wheel printers. Accordingly, the device herein disclosed is to be considered as merely illustrative, and the invention is to be limited only as specified in the claims.

We claim:

1. A print type carrier comprising at least one print type, and at least one test type for use in monitoring and compensating for changes in the flight times of print hammers, said test type having a surface area substantially larger than the surface area of the largest print type carried by said type carrier to enable said test type, when struck by a print hammer, to impact said test type against a record carrier without causing any marking material to be transferred to the record carrier.

2. The device according to claim 1, wherein said test type comprises a surface projecting from said print type carrier.

3. The device according to claim 1 wherein said print type carrier is a closed loop.

4. The device according to claim 1, wherein test type is resiliently connected to said print type carrier to assure a flexible connection between said test type and said print type carrier.

5. A print type carrier comprising at least one print type, and at least one test type for use in monitoring the flight times of print hammers, said test type having a surface area substantially larger than the surface area of the largest print type carried by said type carrier to enable said test type, when struck by a print hammer, to impact said test type against a record carrier without causing any marking material to be transferred to the record carrier.

6. The device according to claim 5, wherein said test type comprises a surface projecting from said print type carrier.

7. The device according to claim 5, wherein said print type carrier is a closed loop.

8. The device according to claim 5, wherein said test type is resiliently connected to said print type carrier to assure a flexible connection between said test type and said print type carrier.

9. A device for monitoring the flight time of a print hammer in an impact printer comprising:

an impact platen;

at least one print hammer;

a print type carrier having at least one print type, said print type carrier intermediate said impact platen and said print hammer;

a record carrier intermediate said print hammer and said impact platen;

a test type attached to said print type carrier for use when monitoring the flight time of said print hammer, said test type having a surface area substantially larger than the surface area of any print type carried by said type carrier to enable an invisible imprint on a record carrier upon impact of said test type by a print hammer;

firing means for initiating a firing signal at the moment of firing of said print hammer;

an impact detector attached to said impact platen for generating an impact signal whenever said record carrier and said test type impact said platen; and evaluator means for measuring the flight time of said print hammer by calculating the elapsed time between said impact signal and said firing signal;

10. The device according to claim 9, wherein the surface area of said type is at least 12 times the area of the largest print type.

11. The device according to claim 9, wherein said test type comprises a surface projecting from said print type carrier.

12. The device according to claim 11, wherein said print type carrier is a closed loop.

13. The device according to claim 12, wherein said test type is resiliently connected to said print type carrier to assure a flexible connection between said test type and said print type carrier.

14. The device according to claim 9, wherein said impact detector is a mechanically acting transducer responsive to shock waves.

15. The device according to claim 9, wherein said impact detector is an electrically acting transducer responsive to shock waves.

16. The device according to claim 15, wherein said impact detector is a strain gauge.

17. The device according to claim 15, wherein said impact detector is a piezoelectric crystal.

18. A device for monitoring and compensating for changes in the flight times of print hammers in an impact printer comprising:

an impact platen;

a plurality of print hammers;

a print type carrier having at least one print type, said print type carrier intermediate said impact platen and said print hammers;

a record carrier intermediate said print hammers and said impact platen;

a test type attached to said print type carrier for use when monitoring the flight time of said print hammers, said test type having a surface area substantially larger than the surface area of any print type carried by said type carrier enable an invisible imprint on a record carrier upon impact of said test type by a print hammer;

firing means initiating firing signals at the moments of firing of said print hammers;

an impact detector attached to said impact platen for generating impact signals whenever said record carrier and said test type impact said platen; and evaluator means for measuring the flight times of said print hammers by calculating the elapsed time between said impact signals and said firing signals;

means for initiating a test cycle of said print hammers utilizing said test type;

means for calculating and storing said flight times for each of said print hammers;

means for determining the deviation of the flight times from said mean value for each of said print hammers; and means for adjusting said firing moments to compensate for said deviations exceeding a predetermined value;

whereby the flight times can be measured, and changes therein can be compensated for, using said test type on said print type carrier without leaving any visible imprint on said record carrier.

19. The device according to claim 18, wherein the surface area of said test type is at least 12 times the area of the largest print type.

20. The device according to claim 18, wherein said test type comprises a surface projecting from said print type carrier.

21. The device according to claim 20, wherein said print type carrier is a closed loop.

22. The device according to claim 21 wherein said test type is resiliently connected to said type carrier to assure a flexible connection between said test type and said print type carrier.

23. The device according to claim 18, wherein said impact detector is a mechanically acting transducer responsive to shock waves.

24. The device according to claim 18, wherein said impact detector is an electrically acting transducer responsive to shock waves.

25. The device according to claim 24, wherein said impact detector is a strain gauge.

26. The device according to claim 24, wherein said impact detector is a piezoelectric crystal.

27. The device of claim 9 or 10 or 11 or 18 or 19 or 20 wherein said print type carrier is a steel band.

28. The device of claim 27 wherein said steel band is a closed loop.

* * * * *